US005878506A

United States Patent [19]

Rautakorpi

[11] Patent Number: 5,878,506

[45] Date of Patent: Mar. 9, 1999

[54] ARRANGEMENT IN AN APPARATUS FOR DRYING A FIBER WEB

[75] Inventor: Paavo Rautakorpi, Tampere, Finland

[73] Assignee: Valmet Corporation, Helsinki, Finland

[21] Appl. No.: 953,205

[22] Filed: Oct. 19, 1997

[30] Foreign Application Priority Data

Oct. 30, 1996 [FI] Finland ..... 964379

[51] Int. Cl.[6] ..... F26B 13/26

[52] U.S. Cl. ..... 34/71; 34/95; 34/119

[58] Field of Search ..... 34/71, 95, 116, 34/119; 100/92, 153, 327; 162/358.1, 358.5, 360.2

[56] References Cited

U.S. PATENT DOCUMENTS

| | | | |
|---|---|---|---|
| 4,461,095 | 7/1984 | Lehtinen | 34/116 |
| 4,738,752 | 4/1988 | Busker et al. | 162/358.5 |
| 5,706,587 | 1/1998 | Lehtinen et al. | 34/71 |
| 5,722,183 | 3/1998 | Orloff et al. | 34/71 |
| 5,778,555 | 7/1998 | Lehtinen et al. | 34/71 |
| 5,799,409 | 9/1998 | Chau-Huu et al. | 34/119 X |

FOREIGN PATENT DOCUMENTS 9611300 4/1996 WIPO .

*Primary Examiner*—Henry Bennett
*Assistant Examiner*—Steve Gravini
*Attorney, Agent, or Firm*—Ladas & Parry

[57] ABSTRACT

An arrangement in an apparatus for drying a fiber web, in which apparatus the fiber web (5) is dried between two tight bands (1, 2) moving in the same direction and turning around turning rolls (6*a, 6b, 7a, 7b*). The first band (1) is heated by means of a pressure chamber (9) and the second band (2) is cooled by means of a water chamber (10). The fiber web (5) is led together with at least one felt or wire (3, 4) through a drying zone formed by the bands (1, 2) in such a way that the fiber web is in contact with the surface of the first band (1) and the felt or wire (3, 4) is between the fiber web (5) and the second band (2). The arrangement comprises means for supporting the wire or wires (3, 4) in such a way that the fiber web (5) is exposed to a compression pressure by the effect of the wire or wires (3, 4) substantially immediately upon coming into contact with the first band.

8 Claims, 2 Drawing Sheets

ARRANGEMENT IN AN APPARATUS FOR DRYING A FIBER WEB

Figure 1:
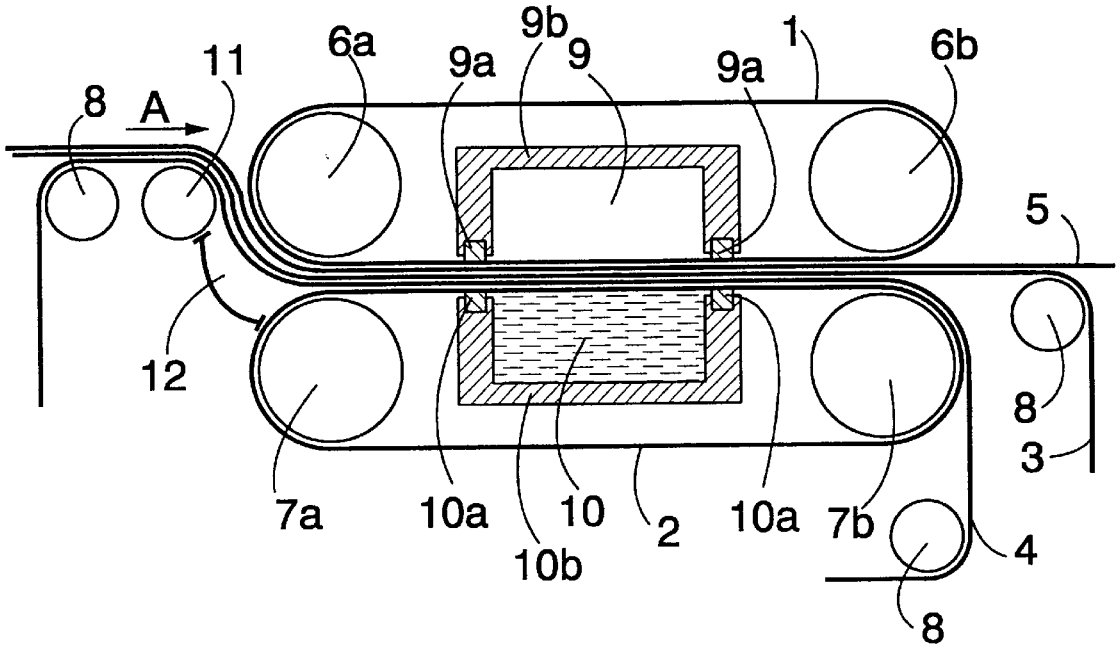

The invention relates to an arrangement in an apparatus for drying a fiber web, the apparatus comprising two endless air impermeable bands, first turning rolls, the first band being arranged to turn around the first turning rolls, and second turning rolls, the second band being arranged to turn around the second turning rolls, whereby the first band and the second band are arranged to run part of the way parallel with each other in such a way that they form a drying zone between them, the first band being arranged to be heated by heating means and the second band being arranged to be cooled by cooling means, whereby the fiber web and at least one felt or wire are led between the bands in such a way that the fiber web is in contact with the heated first band and the felt or wire is between the fiber web and the cooled second band, respectively.

Drying a fiber web between two parallel metal bands moving in the same direction in such a way that the fiber web is in contact with the heated metal band and there is a wire between the fiber web and the second cooled metal band so that the steam separated from the fiber web due to heating condenses to the wire by the effect of the cold metal band, is known from several patent publications, from which can be mentioned e.g. International Patent Application WO 96/11300 and U.S. Pat. No. 4,461,095. The operation is based on that two endless metal bands are arranged to run around turning rolls and that pressure chambers containing hot steam and water, respectively, are provided against the surface defined by the loops formed by the bands so that the pressure produced presses the hot and the cold band, and respectively, the fiber web and the wire between them towards each other. The bands located between the pressure chambers provide by means of seals one side for the pressure chambers so that the steam and water can directly affect the bands. The operation of the apparatus is fully known per se and disclosed e.g. in the above patent applications, which are incorporated herein by reference.

International Patent Application WO 96/11300 discloses that press means are located in the vicinity of the first turning rolls for exposing the fiber web to a stronger compression than the remaining drying zone. However, also in this apparatus, the fiber web is in contact with the hot band even before the fiber web is exposed to a continuous sufficiently strong compression. Then the web begins to dry immediately upon coming into contact with the hot band, which drying reduces the plasticity of the web surface even before the web is exposed to the compression of the pressure chamber. Further, before being exposed to the compression of the pressure chamber, the fiber web may peal, if the temperature inside the web is allowed to rise too much.

The object of the present invention is to provide an arrangement in an apparatus for drying a fiber web, by which arrangement the above drawbacks can be avoided.

The arrangement of the invention is characterized in that it comprises means for supporting a wire or wires in such a way that the fiber web is exposed to a compression pressure by the effect of the wire or the wires substantially immediately upon coming into contact with the first band.

An essential idea of the invention is that, in the arrangement, the fiber web is led by means of wires against the hot band in such a way that the wires wind the fiber web to press against a turning roll, whereby the fiber web is exposed to a press effect provided by the wires simultaneously as it comes into contact with the hot band. Further, the idea of a second embodiment is that the fiber web is pressed against a turning roll in a nip formed by a press roll and a turning roll, after which the fiber web is exposed to a compression effected by the wires. The idea of still a third embodiment is that there are means, for instance a shoe, between the turning roll and the pressure chamber for guiding the hot band in such a way that the compression effected by the wires can be maintained effective.

An advantage of the invention is that the fiber web is exposed to the press effect caused by the wires at the same time as it comes into contact with the hot band, due to which the drying of the web surface has no time to reduce the plasticity of the web surface. Another advantage is that when the wires wind the fiber web against the hot band on a hot surface, the vaporizing water displaces air both from the web and the wires effectively, which increases the speed of drying. Still an advantage is that, by guiding the hot band between the turning roll and the pressure chamber in such a way that an effective compression is provided as far as the pressure chamber, the fiber web can be very well prevented from pealing. Further, by using a shoe for guiding the hot band, the shoe can also be used for preheating the hot band.

The invention is described in greater detail in the attached drawings, where

Figure 2:
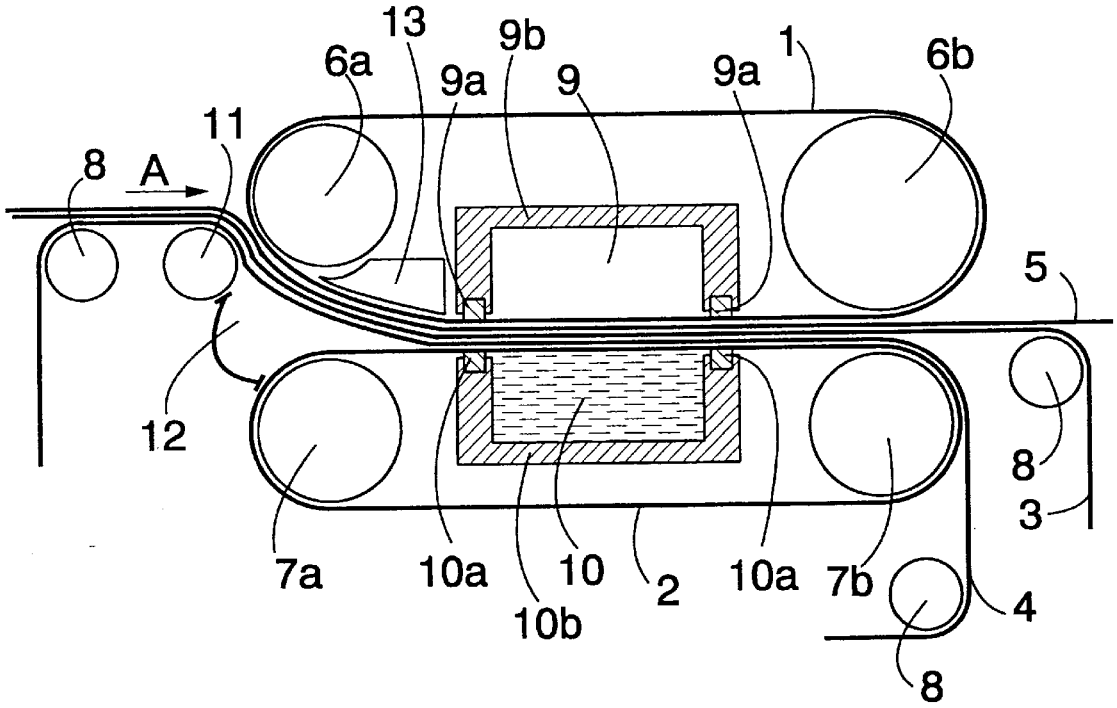
Figure 3:
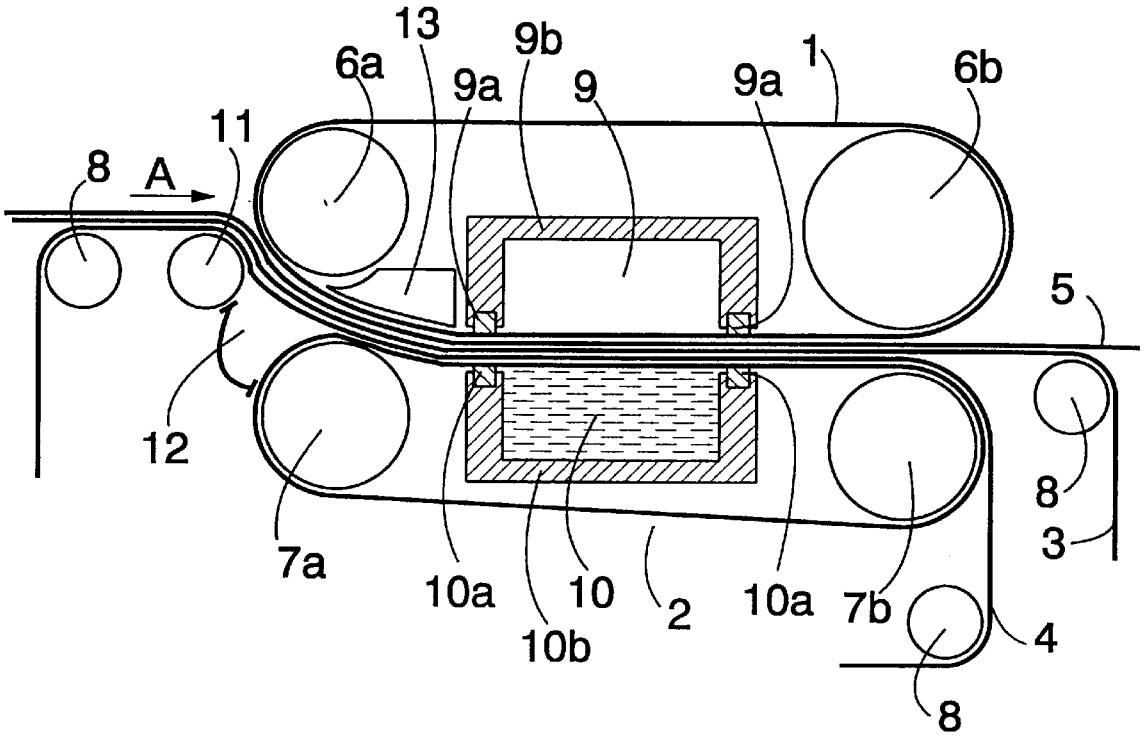

FIG. 1 shows schematically a sectional side view taken in the travel direction of the web, illustrating an arrangement according to the invention, FIG. 2 shows schematically a sectional side view taken in the travel direction of the web, illustrating a second arrangement according to the invention, and FIG. 3 shows schematically a sectional side view taken in the travel direction of the web, illustrating a third arrangement according to the invention.

FIG. 1 is a schematic sectional side view taken in the travel direction of the web, illustrating a drying apparatus according to the invention. The drying apparatus comprises endless bands that are impermeable to air, conduct heat well and are preferably made of metal: viz. a first band 1, i.e. an upper band, and a second band 2, i.e. the lower band, a fine wire or felt 3, a coarse wire 4 and a fiber web 5 running between those surfaces of the bands that face each other. The fiber web 5 moves in the direction indicated by arrow A. The first band 1 is arranged to turn around first turning rolls 6*a* and 6*b* located at the ends of the drying apparatus. Correspondingly, the second band 2 is arranged to turn around second turning rolls 7*a* and 7*b* also located at the ends of the drying apparatus, below the first turning rolls 6*a* and 6*b*. The wires 3 and 4 are supported and guided by means of guide rolls 8. Since the pressure prevailing in the drying zone in the area between the bands 1 and 2 is usually different from the pressure prevailing outside or on the sides of the bands 1 and 2, seals are arranged on both sides of the apparatus between or at the edges of the bands 1 and 2, the seals preventing liquid or gas from moving out of the area between the bands 1 and 2 sidewards, or vice versa. To effect vapor heating required by the drying, the drying apparatus comprises a pressure chamber 9, which is located above the first band 1. The first band 1 is sealed with seals 9*a* to the body 9*b* of the pressure chamber 9 so that the steam in the pressure chamber 9 is maintained at a suitable pressure. Below the second band 2 there is a water chamber 10 containing water that cools the second band 2. At the edges of the water chamber 10 there are seals 10*a*, with which the second band 2 is sealed to the body 10*b* of the water chamber 10.

The operation of the drying apparatus is based on heating the first band 1, which is in contact with the web 5, by hot steam contained in the pressure chamber 9. The temperature of the first band 1 causes that the water in the web 5 is vaporized and transferred through the wires 3 and 4 toward the second band 2. The second band, in turn, is continuously cooled with water located below it, whereby the steam produced on the surface thereof condenses into water and is removed with the band 2 and the wire 4.

The wires 3 and 4 are arranged by means of guide rolls 8 and a press roll 11 in such a way that they lead the fiber web 5 against the turning roll 6*a* and after this wind the fiber web 5 against the turning roll 6*a* so that the fiber web 5 is exposed to a compression by the effect of the wires 3 and 4 substantially from the moment when the fiber web comes into contact with the upper band 1. The press roll 11 may also press the wires 3 and 4 and the fiber web 5 against the turning roll 6*a,* whereby a press nip is provided between the press roll 11 and the turning roll 6*a*. Then the fiber web 5 is pressed immediately upon coming into contact with the upper band 1 strongly against it and the press effect remains rather strong by the effect of the wires 3 and 4. The press roll 11 can also be a suction roll, capable of effecting an underpressure inside the wires 3 and 4 and the fiber web 5.

Moreover, the drying apparatus possibly comprises an air exhaust unit 12, through which the fiber web 5 and the wires 3 and 4 are led before they are led between the bands 1 and 2. In the air exhaust unit, air is exhausted from the pores of the fiber web 5 and the wires 3 and 4 as accurately as possible. In the arrangement of the invention, the air exhaust takes place efficiently even without a special air exhaust unit, because the water vaporizing on the hot surface of the first band 1 displaces the air both from the fiber web 5 and the wires 3 and 4.

FIG. 2 shows a schematic sectional side view taken in the travel direction of the web, illustrating a second drying apparatus of the invention. Reference numerals of FIG. 2 correspond to those of FIG. 1. Between the turning roll 6*a* and the pressure chamber 9 there is a shoe 13, which functions as a means by which the first band 1 and the wires 3 and 4 can be arranged in such a way that the wires 3 and 4 press the fiber web 5 with a rather strong pressure against the first band I until the fiber web is subjected to the compression pressure of the pressure chamber 9. Then the fiber web 5 remains subjected to a rather high compression pressure immediately from the moment it comes into contact with the first band I till the end of the pressure chamber 9. The fiber web 5 is substantially all the time exposed to a compression pressure, which has an advantageous influence on the properties of the fiber web 5.

The shoe 13 can also be used for heating the first band 1. At the shoe 13, the first band is curved by the effect of the shoe 13. For this reason, when the first band 1 is heated by the shoe 13, the shape of the first band 1 does not change essentially at said point, which makes it advantageous to heat the first band 1 at that point. The shoe 13 can be provided in several different manners. It can be hydrostatic or hydrodynamic or a combination of these or provided by sliding faces or in some other manner fully known per se. Instead of the shoe 13, a suitably designed overpressure chamber, for instance, can be used for supporting the first band 1. Further, the first band 1 can be supported for example by thin reels or rolls, a blow box, a rotating chain, or the bands can be supported by sealing faces and pressure, or some other corresponding means can be used.

FIG. 3 shows a schematic sectional side view taken in the travel direction of the web, illustrating a third drying apparatus of the invention. Reference numerals of FIG. 3 correspond to those of the FIGS. 1 and 2. The second band 2 is arranged to support the wires 3 and 4 on the opposite side of the shoe 13. This arrangement is provided for instance by lifting the turning roll 7*a* upwards in FIG. 3. Then the wires 3 and 4 are provided with additional support by the stiffness and tightness of the second band 2, due to which for instance the shoe 13 can be made rather low-gradient, but the fiber web is still subjected to a rather strong compression pressure also at this place. On the other hand, if the first band 1 is heated by the shoe 13, and for this reason, the first band 1 is exposed to an additional pressure from the direction of the shoe 13, an additional support is provided by arranging the second band 2 on the opposite side.

The drawings and the description relating to it are only intended to illustrate the idea of the invention. As to the details, the invention may vary within the scope of the claims. So it is not essential which pressure medium is used in the pressure chamber 9 and the water chamber 10. The medium of the pressure chamber 9 can thus be steam, air or hot combustion products of fuel, or water, for instance. In addition to water, also e.g. air can be used as medium in the water chamber 10.

In addition to the heating by the pressure chamber 9, the first band 1 can also be heated at other places in manners fully known per se. Further, the heating of the first band 1 can take place also entirely outside the pressure chamber 9 or the drying of the fiber web 5 can take place even without a pressure chamber 9.

Moreover, the second band 2 can be cooled also outside the water chamber 10 or the cooling can be implemented even without a water chamber 10 in manners fully known per se.

I claim:

1. Arrangement in an apparatus for drying a fiber web, the apparatus comprising two endless air impermeable bands, first turning rolls, the first band being arranged to turn around the first turning rolls, and second turning rolls, the second band being arranged to turn around the second turning rolls, whereby the first band and the second band are arranged to run part of the way parallel with each other in such a way that they form a drying zone between them, the first band being arranged to be heated by heating means and the second band being arranged to be cooled by cooling means, whereby the fiber web and at least one felt or wire are led between the bands in such a way that the fiber web is in contact with the heated first band and the felt or wire is between the fiber web and the cooled second band, respectively, wherein the arrangement comprises means for supporting a wire or wires in such a way that the fiber web is exposed to a compression pressure by the effect of the wire or the wires substantially immediately upon coming into contact with the first band.

2. Arrangement according to claim 1, wherein the arrangement comprises a press roll in such a way that there is a press nip between the press roll and the turning roll, in which nip the fiber web comes into contact with the first band.

3. Arrangement according to claim 2, wherein the press roll is a suction roll.

4. Arrangement according to claim 1, wherein a chamber containing pressurized medium is arranged against the first band to press the fiber web, there are means between the turning roll and the pressure chamber for guiding the first band in such a way that the compression pressure caused by the wire or wires affects the fiber web substantially up to the moment when the fiber web is subjected to the compression of the pressure chamber.

5. Arrangement according to claim 4, wherein a shoe is used as the means for guiding the first band.

6. Arrangement according to claim 5, wherein the shoe is arranged to heat the first band.

7. Arrangement according to claim 4, wherein the second band is arranged to support the wire or wires at least part of the way provided with means for guiding the first band between the turning roll and the pressure chamber.

8. Arrangement according to claim 1, wherein the arrangement comprises a pressure chamber arranged to heat the first band and a chamber containing pressurized medium and arranged to cool the second band.

* * * * *